United States Patent [19]

Brewer

[11] 4,033,488

[45] * July 5, 1977

[54] HARNESS ARTICLE CARRIER

[76] Inventor: Robert A. Brewer, 15 Castle Park Way, Oakland, Calif. 94611

[ * ] Notice: The portion of the term of this patent subsequent to May 20, 1992, has been disclaimed.

[22] Filed: Mar. 17, 1975

[21] Appl. No.: 558,781

Related U.S. Application Data

[63] Continuation-in-part of Ser. No. 422,734, Dec. 7, 1973, Pat. No. 3,884,403.

[52] U.S. Cl. ..... 224/5 V; 224/5 A

[51] Int. Cl.[2] ..... A45F 5/00

[58] Field of Search ..... 224/5 V, 5 BC, 5 R, 224/5 A, 5 B, 5 E, 5 P, 5 L, 5 S, 5 H, 26 R, 26 B; 2/DIG. 6; 182/3

[56] References Cited

UNITED STATES PATENTS

| | | | |
|---|---|---|---|
| 3,305,148 | 2/1967 | Zimmerman | 224/5 V |
| 3,326,431 | 6/1967 | Belleni | 224/5 V |
| 3,526,347 | 9/1970 | Kuban | 224/5 V |
| 3,884,403 | 5/1975 | Brewer | 224/5 V |

*Primary Examiner*—Robert J. Spar

*Assistant Examiner*—Jerold M. Forsberg

*Attorney, Agent, or Firm*—James R. Cypher

[57] ABSTRACT

A strap which is carried by the body about the back and shoulders for carrying articles and in one form of the invention is also separable so that it forms a basic neck strap. The strap includes an elongated non-elastic flexible neck strap which carries spring releasable couplings at both ends and a length adjustment means. One end of the neck strap is releasably coupled to an elongated non-elastic flexible extension strap which carries coupling means at both ends and a quick release fastener. A camera or other article is releasably attached to either the neck strap by the spring releasable couplings or to a combination of the neck and extension straps by one coupling on each strap and additionally by the quick release fastener. The camera or other article carries a mating quick release fastener either on the article itself or the fastener is attached to a bracket independently connected to the article or camera.

In another form of the invention, the strap is a single member and the camera or other article carries a rigid mechanical quick release fastener. This form of the invention can also be used with the brackets.

1 Claim, 25 Drawing Figures

HARNESS ARTICLE CARRIER

HISTORY

This application is a continuation-in-part of my earlier filed pending application Ser. No. 422,734, filed Dec. 7, 1973, now U.S. Pat. No. 3,884,403.

BACKGROUND OF THE INVENTION

Cameras, binoculars, sound equipment, breathing equipment and many other portable articles are commonly fitted with straps so that they may hang from the neck about the chest area in order that they may be raised to head or eye level for instant use. The problems of hanging relatively heavy articles about the neck for long periods of time by a single strap have been recognized for some time and there are now several harness arrangements available on the market and in the literature. Such harnesses are relatively expensive or suitable for only one type of equipment and therefore they have not found ready acceptance. Other harnesses require modifications in the articles being carried; the addition of brackets or the drilling of holes in expensive camera cases defacing the instruments.

My prior filed application for Article Carrying Strap identified above provides a harness which solves the long-felt needs just mentioned, but many persons desire to have an article carrying strap which can serve both as a harness and a basic neck strap.

In addition, it has been found that many persons who own expensive cameras do not wish to permanently attach a quick release fastener to either their camera or their camera case in order to releasably attach to the harness. Finally, the harnesses on the market do not provide a mechanical quick release fastening which has sufficient holding power for some applications.

SUMMARY OF THE INVENTION

The gist of one form of the present invention is the use of two straps joined by a releasable coupling member so that an article can be carried either by a basic neck strap or by a harness which is supported by the shoulders and back. The harness carries a quick release fastener for releasably fastening the article to the harness so that the article is firmly attached to the chest area of the wearer. When the article is releasably attached to the harness, the article can be easily and quickly unfastened, raised from the chest area to the head area and repositioned and refastened about the chest area with nearly equal speed and ease.

An object of the present invention is to provide a single item which can be purchased and used as both a harness and a neckstrap.

Another object of the present invention is to provide an article carrying strap as above described which is provided with a rigid, mechanical quick release fastening means which will firmly but releasably attach the article to the harness in activities where the wearer experiences considerable movement.

A further object is to provide a bracket which can be releasably attached to a camera or other article which carries a threaded opening for tripods or other equipment and does not require any permanent attachment of a releasable fastener to the camera or the article or a case for the camera or article.

A further object is to provide a harness and neck strap unit as described which can be used to carry a great many different types of articles with no modification of the carried articles.

BRIEF DESCRIPTION OF THE PREFERRED EMBODIMENTS OF THE INVENTION

Figures 1, 2, 3, 4:
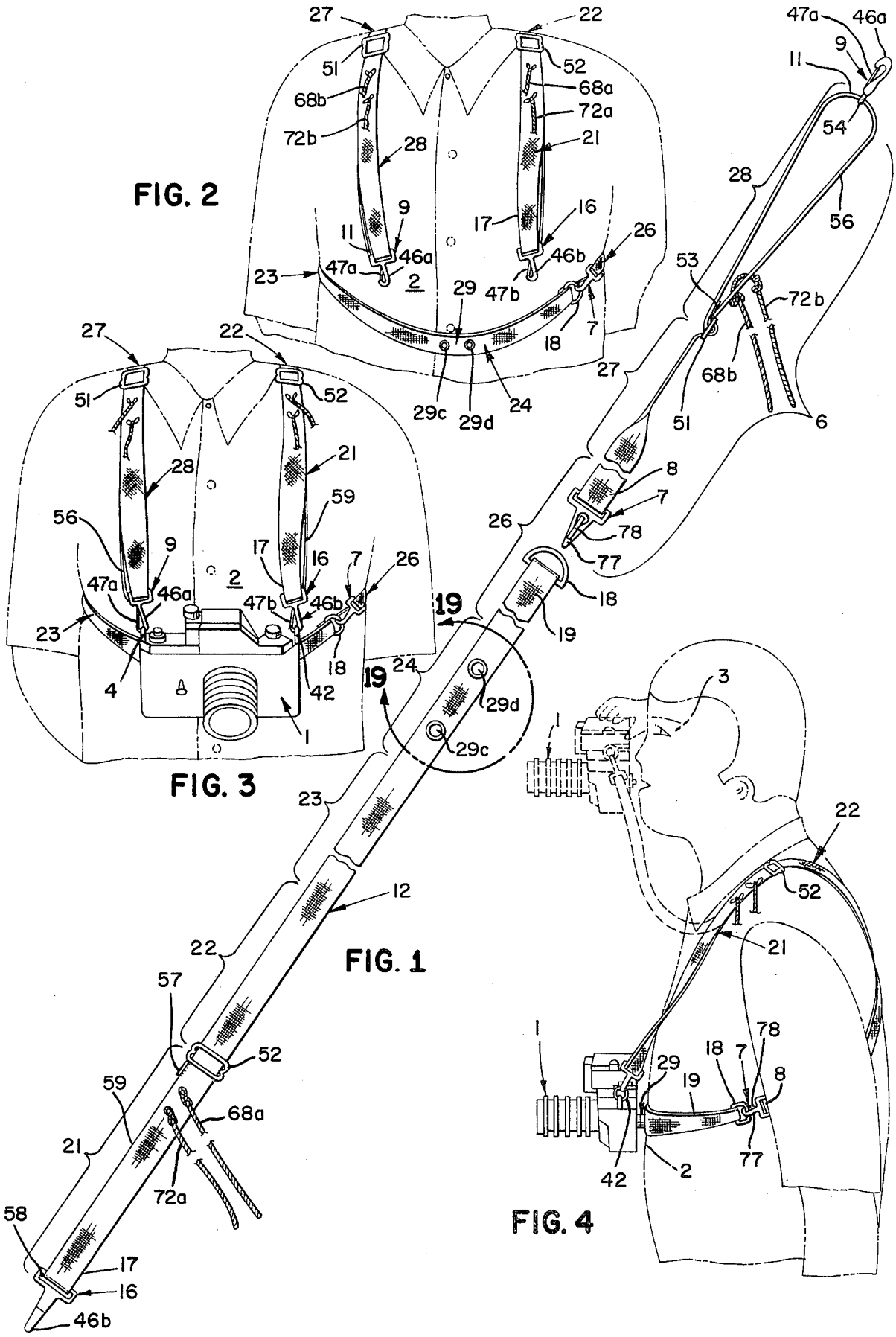
FIG. 1 is a side view of the harness and neck strap constructed in accordance with the present invention.
FIG. 2 is a front view o the torso of the wearer with the strap of FIG. 1 in place.
FIG. 3 is a front view of the torso of the wearer with the strap connected to an article such as a camera.
FIG. 4 is a side view of a person wearing the strap of the present invention. The solid line drawing shows the carrying position of the article and strap and the dotted line shows the eye level position of the article and strap.

The present invention consists briefly of the following elements in combination: a first article 1 and a harness adapted to releasably hold said article against the chest 2 of the wearer in a carrying position and permitting selective eye level positioning 3 in a operating position comprising:

a. said first article 1 having an apertured coupling element 4 thereon;
b. a neck strap 6 consisting of a single flexible nonelastic elongated member;
c. a first spring releasable coupling member 7 attached to a first end 8 of said neck strap and dimensioned to releasably couple to said apertured coupling element on said article;
d. connecting means 9 attaching said second end 11 of said neck strap to said article;
e. an extension strap 12 consisting of a single flexible nonelastic elongated member;
f. a second spring releasable coupling member 16 attached to a first end 17 of said extension member
g. a coupling means 18 such as a D ring is attached to the second end 19 of said extension member;
h. said extension strap and neck strap coupled together by said couplings 7 and 18 consist of a flexible nonelastic elongated member having the following portions and have a length adapted to span the distance from the wearer's chest (first chest portion) 21, over one shoulder (first shoulder portion) 22, under the arm (first under arm portion) 23, across the chest (transverse chest portion) 24, under the second arm (second under arm portion) 26, over the second shoulder (second shoulder portion) 27, and back to the chest (second chest portion) 28;
i. quick release fastener means 29 mounted on said first article below said apertured coupling element 4 fo releasably connecting said article 1 to said extension member 12.

Figure 7:
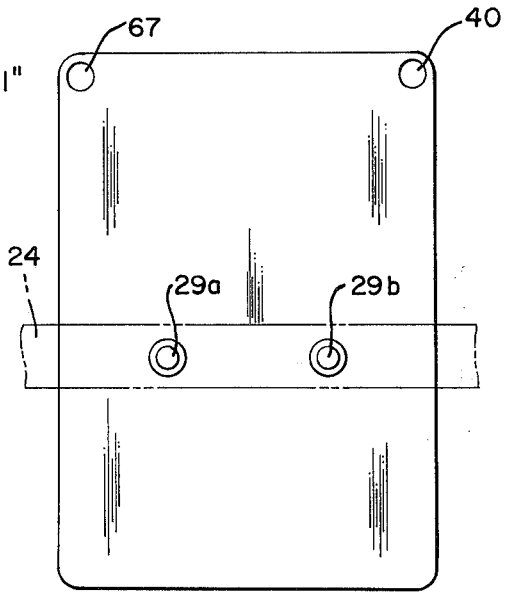
FIG. 7 is the rear view of the article shown in FIG. 6.

In the form of the invention shown in FIGS. 1 through 4, the quick release fastener means 29 on the first article includes the M portion 29 and 29 of a pair of laterally spaced male/female snap couplings like the male snaps shown in FIG. 7 and the quick release fastener means also includes the F poritons 29*c* and 29*d* of a pair of laterally spaced male/female snap couplings connected to the strap extension member 12 for registration with the M portions 29 on the first article 1. The snap couplings are standard items made by several manufacturers.

In the specification and drawings, the letter M stands for the male portion of the snaps and the letter F stands for the female portion of the snaps. In the claims, however, the letters F and M may stand for either the male or female snap since obviously it is possible to reverse the snaps so that the male portion could be on the strap and the female portion on the article.

The strap is preferably a flexible woven material such as nylon, having a suitable width to take the load of the camera, or other article. One inch nylon webbing is readily available and provides sufficient strength and load bearing surface.

The article referred to in this application may be a camera and wherever the term "article" or "camera" is used, it is meant to include but not be limited to the following where applicable: camera, binoculars, naturalist's or explorer's field kit, musical instruments, surgical or medical equipment, tools, first aid kit, surveyor's instruments, weapons, tape recorder, microphone, two-way radio, portable amplifier, gas mask, or any other equipment or supplies that a person might want to lift to his face or have immediately accessible.

An alternate means of releasably attaching the article to the strap is shown in FIGS. 11–15. In this form of the invention, the article is formed with a pair of vertical slots 32′ and 33′ adjacent the sides with transverse openings 34′ and 36′ communicating with the sides 31 and 35 for removably receiving the transverse chest portion 24 of the strap. When the strap is threaded through the slots, the article cannot move vertically or away from the person's chest and is frictionally restrained from moving laterally.

The article 1′ shown in FIGS. 11–15 is merely illustrative of a number of different types of articles that may be carried by the strap. For example, the article may consist of a rectangular sheet metal member with sides 37, a front 38 and a bottom 39 forming an open receptacle for receiving tools, instruments and the like.

Only a single apertured element 40′ in the article 1′ is required as shown in FIGS. 11–15. A single spring releasable coupling member 16′ is connected to the strap and is dimensioned to be received in the opening 40′. The other end 41 of the strap is non-releasably affixed to the upper portion of the article 1′.

Cameras and binoculars are generally constructed with two spaced apertured elements such as rings 4 and 42. The connecting means preferably are spring releasable couplings and consist of a J hook 46*a* and 46*b* and spring tongues 47*a* and 47*b* and releasably connects to the rings 4 and 42 connected to the camera.

A unique feature of the present invention is the fact that the strap is but a single length. The strap could be a relatively short length of material with the coupling means on the very end, but preferably the strap is fitted with at least one strap adjustment member 51 for adjusting the length of the strap to fit the wearer. A second strap adjustment member 52 may also be used to give additional adjustability. An end 53 of the strap is threaded through an opening 54 in the coupling member forming a strap loop 56 and is then threaded through the adjustment member 51.

In like manner, an end 57 of the strap is threaded through an opening 58 in coupling 16, forming a loop 59 in the extension strap 12 and then is threaded through adjustment member 52.

Figure 19:
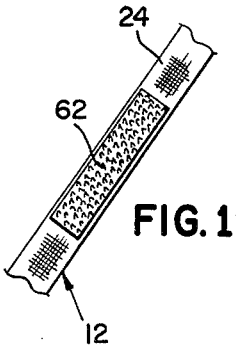
FIG. 19 is a portion of the strap shown in FIG. 1 in the vicinity of lines 19—19 showing an alternate quick release fastener means.
Figure 20:
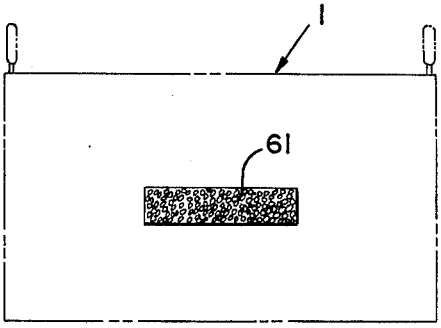
FIG. 20 is a view of the back of a camera or other article showing the loop portion of a Velcro type quick release fastener used with the quick release hook portion of the Velcro material shown in FIG. 19.

Another means of releasably attaching an article such as a camera to the combination neck strap 6 and extension 12 is to attach the loop portion 61 of a hook and loop fastener to the back portion of the article 1 as shown in FIG. 20. A suitable hook and loop fastener is a product sold under the trademark Velcro. The hook portion 62 of the hook and loop fastener is attached to the front of the transverse chest portion 24 of the strap as shown in FIG. 19. Preferably the loop portion is about 4 in. long and 1 in. wide and is attached to the camera and the hook portion of the Velcro fastener is attached to the strap but the arrangement could be reversed. When constructed in the preferred manner, the loop portions on the camera will not snag the clothing of the wearer whereas, the hook portions of the strap are always turned outwardly.

Figure 6:
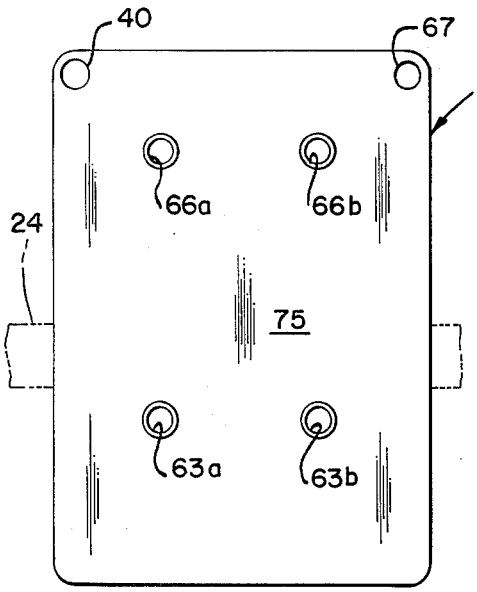
FIG. 6 is the front view of a modified form of an article used with the strap of FIG. 1.
Figure 8:
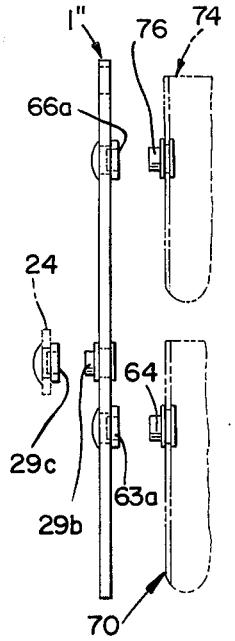
FIG. 8 is a side view of the article shown in FIGS. 6 and 7.
Figure 5:
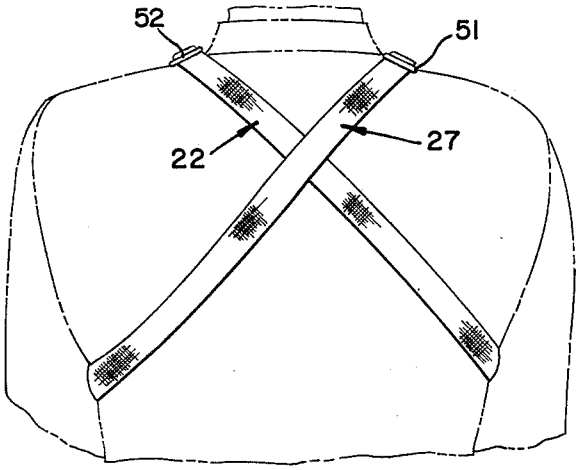
FIG. 5 is a back view of the strap shown in FIG. 1.
Figure 9:
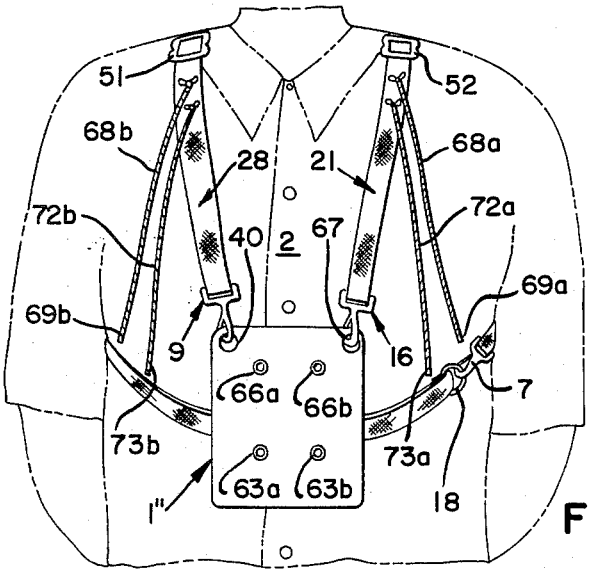
FIG. 9 is a front view of a modified form of the strap with the article of FIGS. 6, 7, and 8 for carrying two articles such as two cameras.

An alternate form of article instead of the camera shown in FIGS. 3 and 4 or the box shown in FIGS. 11–14 may be a simple planar plate as shown in FIGS. 6–8. In this form of the invention, the plate 1″ may have a pair of female snaps 63*a* and 63*b* attached to its front face. Any tool or instrument which is desired to be carried may then be constructed with male snaps 64 an thus be releasably attached to the article 1″. The article 1″ may have either the slots like slots 32′ and 33′ for attachment to the strap portion 24 or male snaps 29*a* and 29*b* may be attached to the back of the article as shown in FIG. 7.

Still another alternate form of the invention is illustrated in FIGS. 6–10. This form of the invention shows a system of carrying two cameras or two pairs of binoculars or the like.

Figure 10:
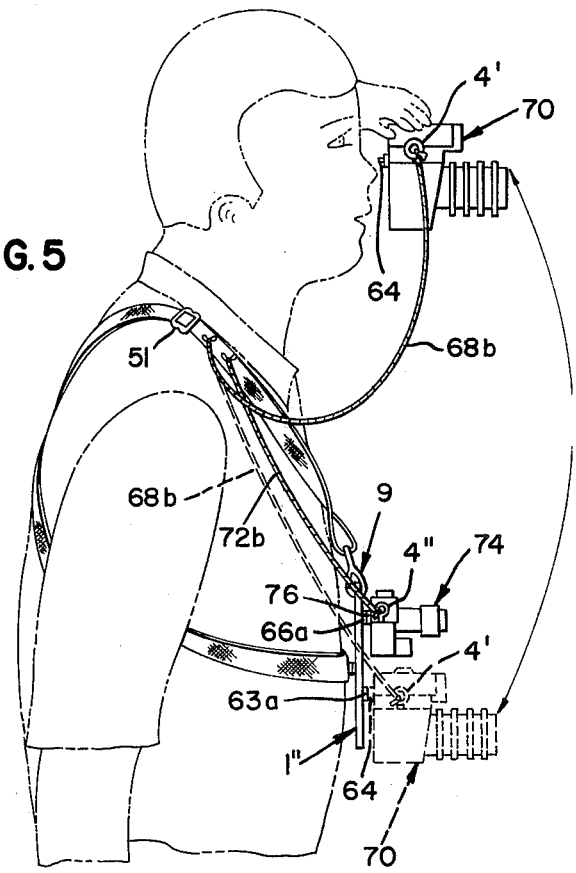
FIG. 10 is a side view of the combination shown in FIG. 9.
Figure 11:
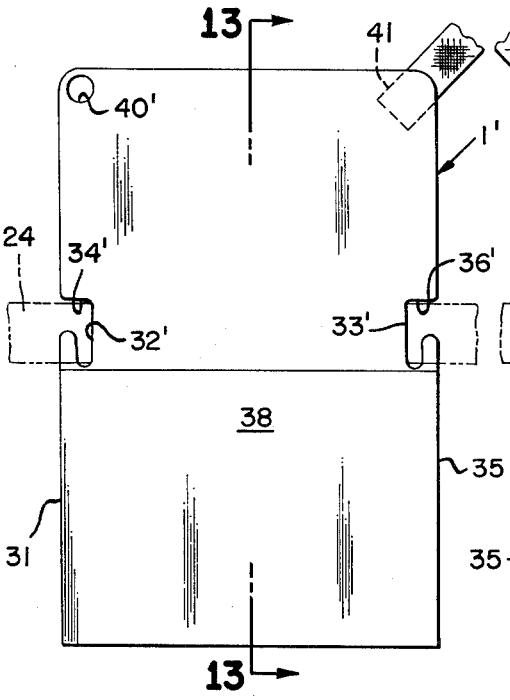
FIG. 11 is a front view of still another modified form of an article.
Figure 12:
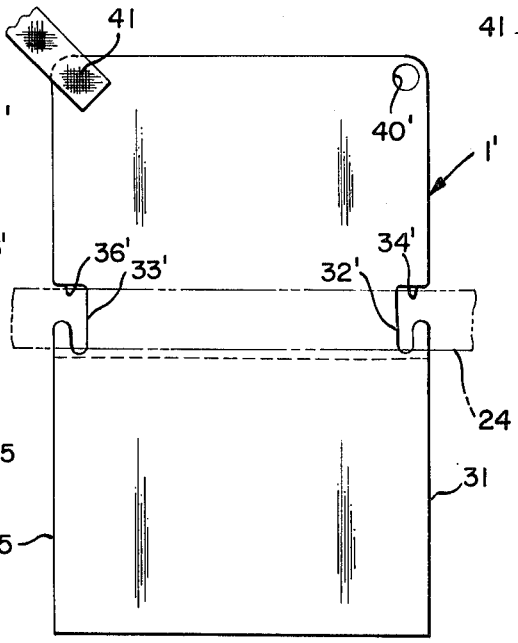
FIG. 12 is the back view of the article shown in FIG. 11.

The front face 75 of the first article 1″ is formed with a second row of female snaps 66*a* and 66*b* spaced above a first row of snaps 63*a* and 63*b*. The article 1″ may be formed with a single apertured opening 40 but preferably is formed with a second opening 67. In order to hold a pair of cameras, a first pair of elongated cords 68*a* and 68*b* are attached to the first chest strap portion 21 and the second chest strap portion 28 respectively. The ends of the cords 69*a* and 69*b* are then attached to the coupling elements 4′ and 42′ on the camera 70 as shown in FIG. 10.

A second pair of elongated cords 72*a* and 72*b* are attached to the first and second chest strap portions of said strap. The ends of the cord 73*a* and 73*b* are attached to a third article such as a second camera 74 at its coupling ring 4″.

The second article or camera 70 is attached to the article 1″ by means of male snaps 64 attached to the back of the camera on the camera case. Camera 70 is attached to female snaps 63*a* and 63*b* which are attached to the front face of article 1″.

A third article or camera 74 is attached to the front side 75 of article 1″ by means of male snap 78 attached to its back face. The male snaps 76 connect to female snaps 66*a* and 66*b* attached to the front face of the article 1″.

The operation of all of the forms of the invention are similar and may be illustrated by referring to FIGS. 1–4. The strap may be placed around the body in the following manner. First, the camera 1 is held in the left hand, close to the face and with the lens facing away from the body. With the right hand, coupling 16 is attached to ring 42 on the left side of the camera. The loose end 11 of the strap is then dropped over the left shoulder so it hangs down behind the wearer. Any twists between the camera and the body should be removed. Next, the person should reach behind at waist level with the right hand and bring the hanging part of the strap under the right arm to the front of the chest. The snaps 29*c* and 29*d* on the strap should be facing forward and there should be no twists. The right hand should continue the motion of the strap around the body, bringing the hanging part of the strap under the left arm, behind the neck and over the right shoulder. The end of the strap with coupling 9 should then be attached to the ring 4 on the right side of the camera. The snaps 29*c* and 29*d* should then be juxtaposed and pressed against snaps 29*a* and 29*b* on the camera. The strap is now a harness. Other methods of placing the strap in harness form may be also used as the person becomes familiar with the method.

As shown in FIG. 4, the camera or other article is carried at chest level. The snap fasteners firmly hold the camera to the chest of the wearer. When the camera is to be used, it is a simple matter to firmly pull the camera away from the chest, thereby causing the snaps to release. The camera is then raised with the camera and since they are still attached to the camera, the camera will not fall if accidentally realeased. To replace the camera to the carrying position, the snaps are once again juxtaposed and pressed firmly together.

Figure 18:
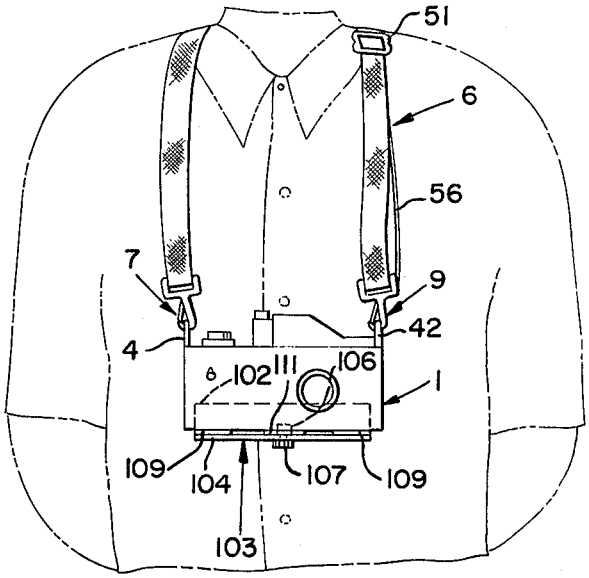
FIG. 18 is a front view of the bracket shown in FIGS. 21 and 22 shown in use with a neck strap constructed in accordance with the present invention.

FIG. 18 shows the prior art method of attaching a camera 1 to the apertured coupling elements 4 and 42 by means of the neck strap 6 only. In this form of the invention, the extension member 12 is simply disconnected from the neck strap portion and not used. FIG. 18 also shows a bracket 103 which is a form of invention described below.

Figure 14:
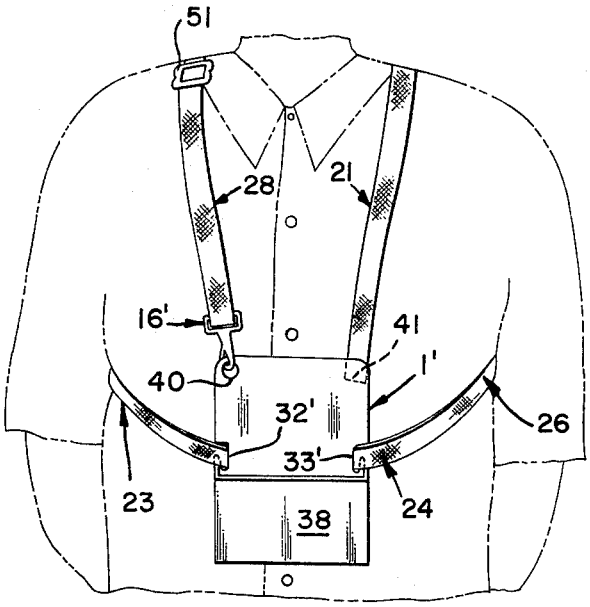
FIG. 14 is a front view of a modified form of the strap and article.
Figure 15:
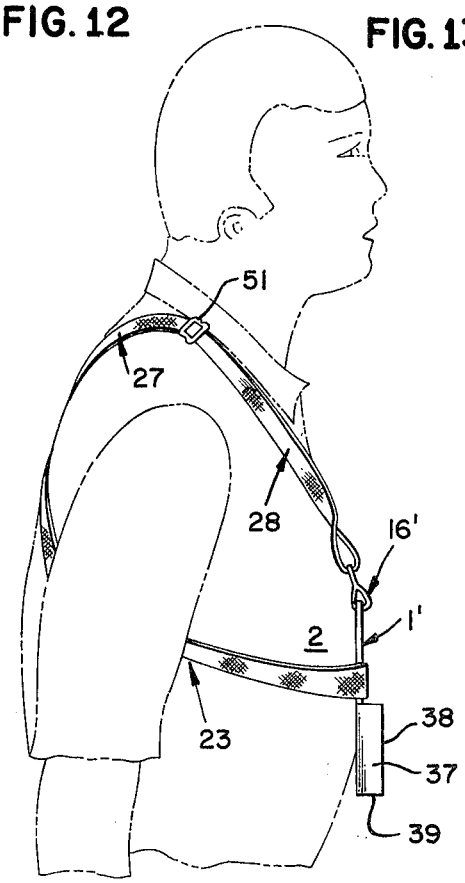
FIG. 15 is a side view of the strap and article shown in FIGS. 11–14.

In all of the above described forms of the invention, the neck strap 6 has been used in conjunction with the extension member 12. It may be understood that a simple strap may be used which consists of a single elongated strap as illustrated in FIGS. 14 and 15. In effect, the D ring 18 and the spring release coupling 7 consisting of its J hook and spring tongue 78 are eliminated and the ends of the strap simply joined together. Since it is obvious that such a single strap having spring releasable couplings like 9 and 16 would operate in a similar manner as the combination neck strap and extension strap, the description is not repeated except by reference to FIGS. 14 and 15. It should be noted however, that the claims do not cover the single elongated strap with a Velcro fastener since this form of the invention is covered in my previously filed application set forth above.

The combination of a single strap constructed without the neck strap as described above is claimed in combination with the quick release fasteners 29*c* and 29*d* which attach to matching quick release fasteners 29*a* and 29*b* on camera 1.

The combination of a single strap constructed without the neck strap as described above is also claimed in combination with two apertured couplings 40 and 67 and two releasable couplings 16 and 9 with strap adjustment means 51 and 52 at both ends.

Figure 13:
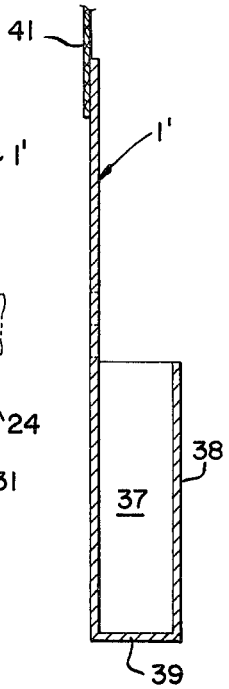
FIG. 13 is a cross sectional view of the article shown in FIG. 11 taken along line 13—13.

Another form of the invention is the single strap without the neck strap and extension strap combination used in combination with the box shown in FIG. 13.

Still another combination is the use of the single strap without the neck strap and extension strap which is formed in the manner above described and used in combination with the article 1″ shown in FIGS. 6 and 7 and used to hold two cameras as shown in FIG. 10 by means of quick release snap couplings 66*a*, 66*b*, 63*a* and 63*b*.

Figure 23:
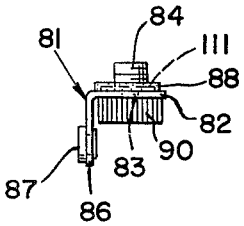
FIG. 23 is a side elevation view of still another form of bracket using a single snap for connection to the strap.
Figure 24:
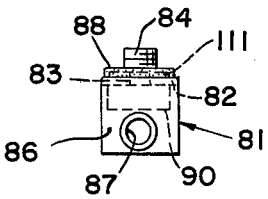
FIG. 24 is a rear elevations view of the bracket shown in FIG. 23.

Still another form of the invention is illustrated in FIGS. 23 and 24. The purpose of this form of the invention is to provide a means for using the harness of the present invention without attaching any quick release fastener means directly to the camera. This form of the invention utilizes the tripod threaded opening which is present in the bottom face of the case in almost every camera. The quick release rigid mechanical strap engaging means in this form of the invention includes an L shaped bracket 81 having a first leg 82 formed with an opening 83 for receiving a threaded shank 84 adapted for threadably coupling with a tripod threaded opening in a camera and a second leg 86 extending at right angles to the first leg, and a quick release strap engaging means 87 such as a female snap mounted on the second leg of the bracket for holding the first article to the strap. The bracket is very small, being about an inch wide and each leg being about an inch long. A soft pad 88 is provided on leg 82 to prevent marring the finish of the camera. A finger actuated knob 90 is attached to the threaded shank.

Figure 25:
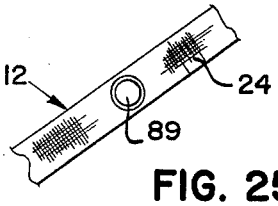
FIG. 25 is a portion of the strap shown in FIG. 1 in the vicinity of lines 19—19 showing an alternate quick release fastener means.

The single snap bracket just described may be used either with the combination strap consisting of a neck strap and extension member with a single snap 89 on the extension member as shown in FIG. 25. Or it may be used with a single elongated strap like the strap constructed in the description set forth in FIGS. 14 and 15, except with spring release couplings on both ends of the strap.

Figure 16:
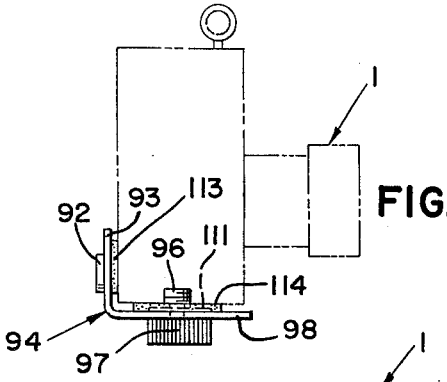
FIG. 16 is a side view of a bracket for attachment to the article and to the harness.
Figure 17:
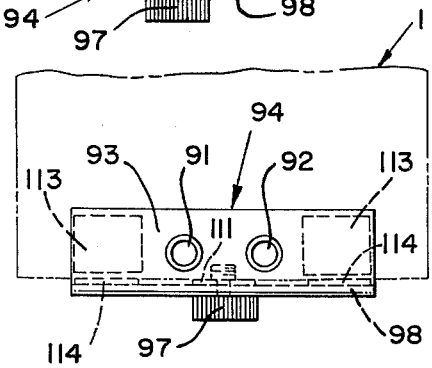
FIG. 17 is a rear elevation view of the bracket of FIG. 16.

Still another form of the invention is shown in FIGS. 16 and 17. In this form of the invention the strap, which may be either the combination neck strap and extension or the single strap, is formed with a pair of laterally spaced M portions such as the male portions of a male/-female snap coupling attached to the transverse chest portion 24 of the strap such as the snaps 29*c* and 29*d* illustrated in FIG. 1. A pair of F portions or female portions of a pair of laterally spaced male/female snap couplings 91 and 92 are mounted on the second leg 93 of a bracket 94 for coupling to the male snaps on the strap. As set forth above, a threaded shank 96 is provided with a finger actuated knob 97 which turns the threaded shank into the tripod opening of the camera case. The shank is mounted on a horizontally extending leg 98.

Figure 21:
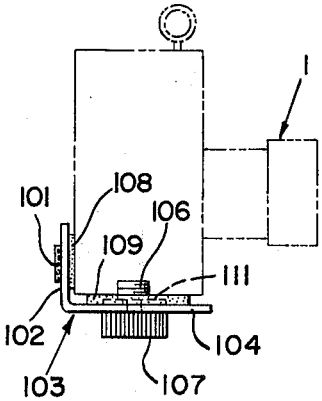
FIG. 21 is a side elevation view of a modified form of bracket using Velcro material as the quick release fastener means.
Figure 22:
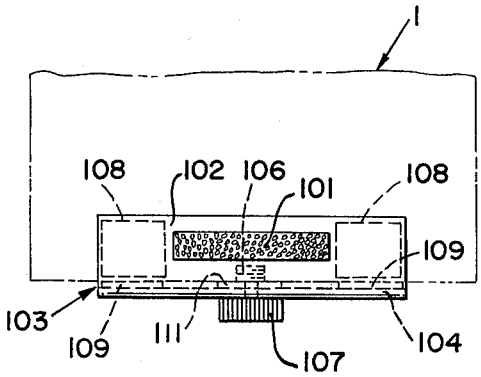
FIG. 22 is a rear elevation view of the bracket shown in FIG. 21.

A modified form of the bracket illustrated in FIGS. 16 and 17 is shown in FIGS. 21, 22 and 18. In this form of the invention either the combination neck strap and extension or the single length strap is provided with the hook portions 62 of a hook and loop fastener means attached to the transverse chest portion 24 of the strap shown in FIG. 19. Loop portions 101 of a hook and loop fastener means are attached to the second leg 102 of an L shaped bracket 103 for releasable attachment to the hook portions of the fastener mounted on the strap. As previously described, a first leg 104 carries a threaded shank 106 which fits into the threaded tripod opening of the camera. A head 107 is provided on the threaded shank. Pads 108 and 109 are provided on the insides of the legs of the bracket to protect the finish of the camera. A horse shoe shaped lock washer 111 may be used to prevent the shank of the thumb screws from separating from the brackets.

The bracket illustrated in FIGS. 16 and 17 is constructed with foam pads 113 on leg 93 and pad 114 on leg 98 to protect the finish on the camera.

I claim:

1. In combination, a first article, and a harness which is convertible to a neck strap which are both adapted to releasably hold said article against the chest of the wearer in a carrying position and permit selective eye level positioning in an operating position in either the neck strap of harness mode comprising:

a. said first article having a pair of apertured coupling elements thereon;

b. a neck strap consisting of a single flexible non-elastic elongated member;

c. a first spring releasable coupling member attached to a first end of said neck strap and dimensioned to releasably couple to one of said apertured coupling elements on said article when used in said neck strap mode;

d. connecting means attaching said second end of said neck strap to said first article;

e. an extension strap consisting of a single flexible non-elastic elongated member for selective use in said harness mode;

f. a second spring releasable coupling member attached to a first end of said extension member and dimensioned to releasably couple to the other of said apertured coupling elements on said first article;

g. a coupling means attached to the second end of said extension member for releasably coupling to said first spring releasable coupling element when used in said harness mode;

h. said extension strap and neck when coupled together in said harness mode consists of a flexible non-elastic elongated member having the following portions and having a length adapted to span the distance from the wearer's chest (first chest portion), over one shoulder (first shoulder portion), under the arm (first under arm portion), across the chest (transverse chest portion), under the second arm (second under arm portion), over the second shoulder (second shoulder portion), and back to the chest (second chest portion);

i. first quick release fastener means mounted on said first article below said apertured coupling element for releasably connecting said article to said extension member;

j. second quick release fastener means connected to said strap extension member adjacent said second end whereby said second quick release fastener means is adapted for location in the mid-portion area of the front of the wearer's chest;

k. said first quick release fastener means on said first article includes a portion of a snap coupling; and l. said second quick release fastener means includes the mating portion of said snap coupling.

* * * * *